US007488152B2

(12) United States Patent
Liang

(10) Patent No.: US 7,488,152 B2
(45) Date of Patent: Feb. 10, 2009

(54) VIBRATION ABSORPTION DEVICE FOR A FAN

(75) Inventor: Chien-Fa Liang, Chung-Ho (TW)

(73) Assignee: Super Micro Computer, Inc., San Jose, CA (US)

( * ) Notice: Subject to any disclaimer, the term of this patent is extended or adjusted under 35 U.S.C. 154(b) by 479 days.

(21) Appl. No.: 11/400,186

(22) Filed: Apr. 10, 2006

(65) Prior Publication Data

US 2007/0237625 A1 Oct. 11, 2007

(51) Int. Cl.
*F01D 5/00* (2006.01)

(52) U.S. Cl. ..... 415/119; 415/213.1

(58) Field of Classification Search ..... 415/119, 415/213.1, 220; 16/2.1; 454/184; 361/695; 403/205, 295, 365, 372
See application file for complete search history.

(56) References Cited

U.S. PATENT DOCUMENTS 6,556,437 B1 * 4/2003 Hardin ..... 361/687
6,839,233 B2 * 1/2005 Cravens et al. ..... 361/695

* cited by examiner

*Primary Examiner*—Edward Look
*Assistant Examiner*—Sean J Younger
(74) *Attorney, Agent, or Firm*—Troxell Law Office, PLLC

(57) ABSTRACT

A vibration absorption for a fan includes a frame, fans, positioning outer jackets, and pins, wherein the positioning outer jacket is inserted into a latching hole of fan, an outer-projected circular ring of pin is attached to a first groove of frame, and a circular ring of ping is attached to a second groove of frame, so as to reduce a vibration force of fans and to increase a flow rate and a flow speed of air flowing out of the fans.

5 Claims, 7 Drawing Sheets

VIBRATION ABSORPTION DEVICE FOR A FAN

BACKGROUND OF THE INVENTION a) Field of the Invention

The present invention relates to a vibration absorption device for a fan, and more particularly to a vibration absorption device for a fan which is fixed in a casing of computer host and can further reduce a vibration force.

b) Description of the Prior Art

A Taiwan Utility Patent 093119732, "Fan Device for a Computer Host," created by the present inventor is very practical. However, this conventional technique is still provided with the following shortcomings under a long term of usage and a requirement of more improvement:

(1) Two side walls of the container used for fixing the fans are provided with a plurality of about circular air guiding holes and frame bodies. Therefore, the space of air guiding holes is small, and the air flow blown from the fans is easily to blow toward the frame bodies other than the air guiding holes or the walls of rims of air guiding holes, which will enable a loss of efficiency of flow speed and flow rate of the air flow, and will also increase the manufacturing cost of container.

(2) The positioning outer jackets 30 can only transmit the vibration force of torsion generated by the fans to the container 10 and cannot directly transmit to the substrate of computer casing; therefore, the efficiency of vibration absorption needs to be improved slightly.

(3) The pin 44 is provided with the identical outer diameter. Therefore, when it is transfixed into the positioning hole 34 and is further tightly inserted into the pre-built latching hole 22 of the fan, the pin 44 and the positioning outer jacket 30 are not tightly fixed into the latching hole 22. In other words, the pin 40 or the positioning outer jacket 30 is easily to be dislocated or even fallen off due to vibration, under a loose fitting condition.

SUMMARY OF THE INVENTION

The primary object of present invention is to provide a vibration absorption device for a fan which is provided with a frame having a plurality of U-shape sinks, to increase a flow rate and a flow speed of air flowing out of the fans, and to reduce a material cost of the frame.

Another object of the present invention is to provide a vibration absorption device for a fan, wherein positioning outer jackets can be in contact with a substrate of computer casing to further transmit a vibration force onto the substrate, thereby further reducing the vibration force upon driving the fans.

Still another object of the present invention is to provide a vibration absorption device for a fan, wherein a projected arc member of larger outer diameter is formed on a circumference of pin to tightly insert the positioning outer jacket into a latching hole of fan, so as to further tightly insert the pin and the positioning outer jacket into the latching hole, thereby preventing the pin or positioning outer jacket from being fallen off due to a vibration caused by a long term rotation of the fan.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
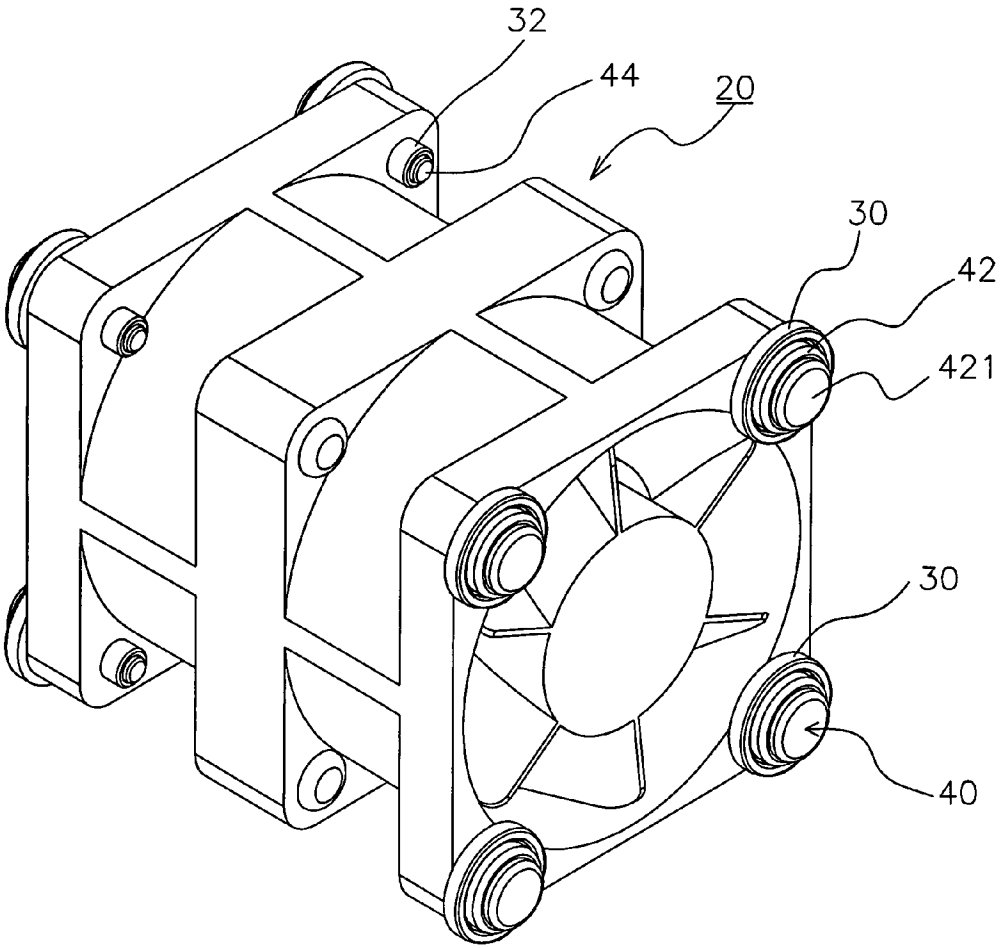
FIG. 1 shows a perspective view of a fan of the present invention.
Figure 2:
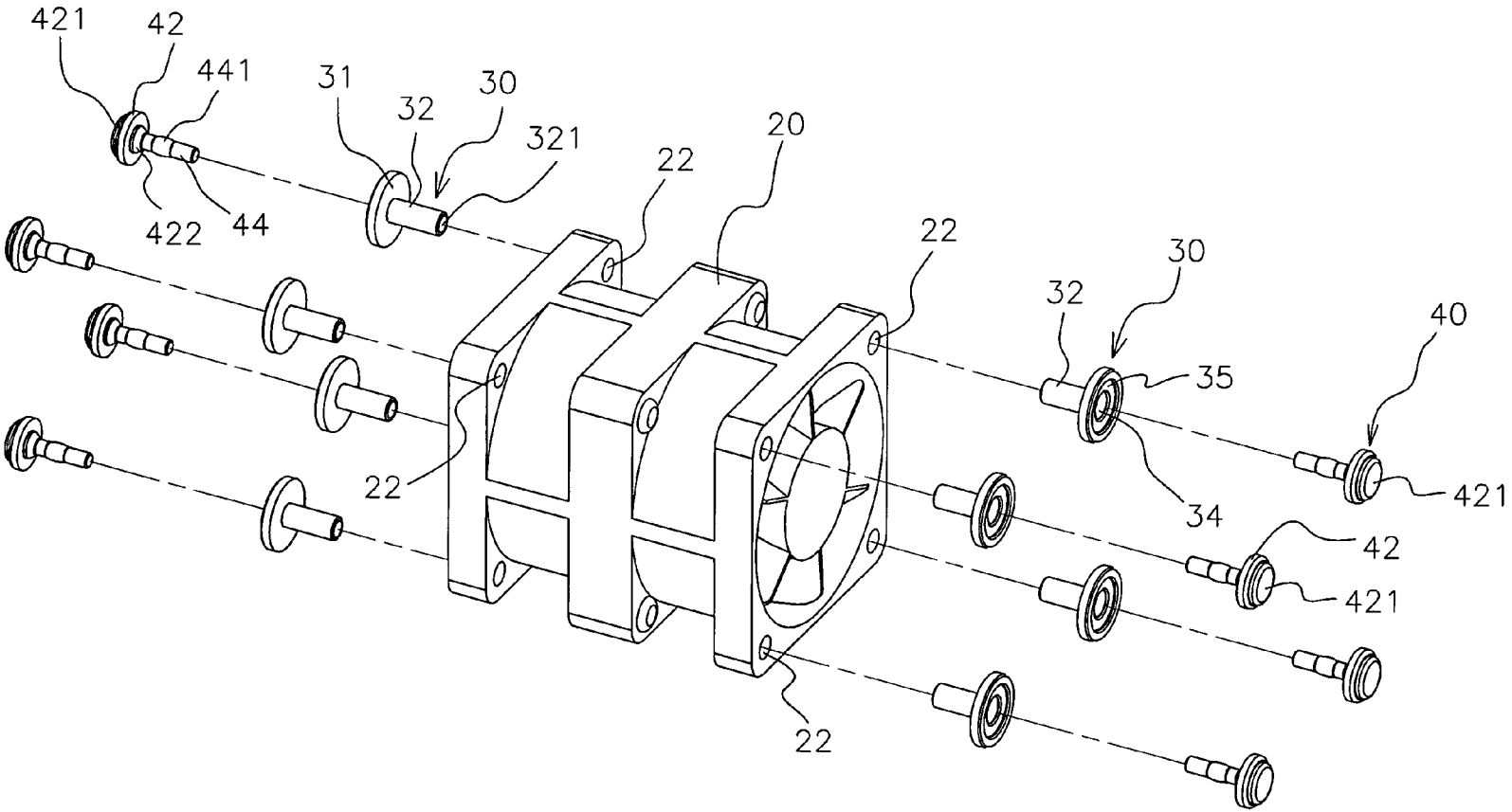
FIG. 2 shows an exploded view of components of a fan of the present invention.
Figure 7:
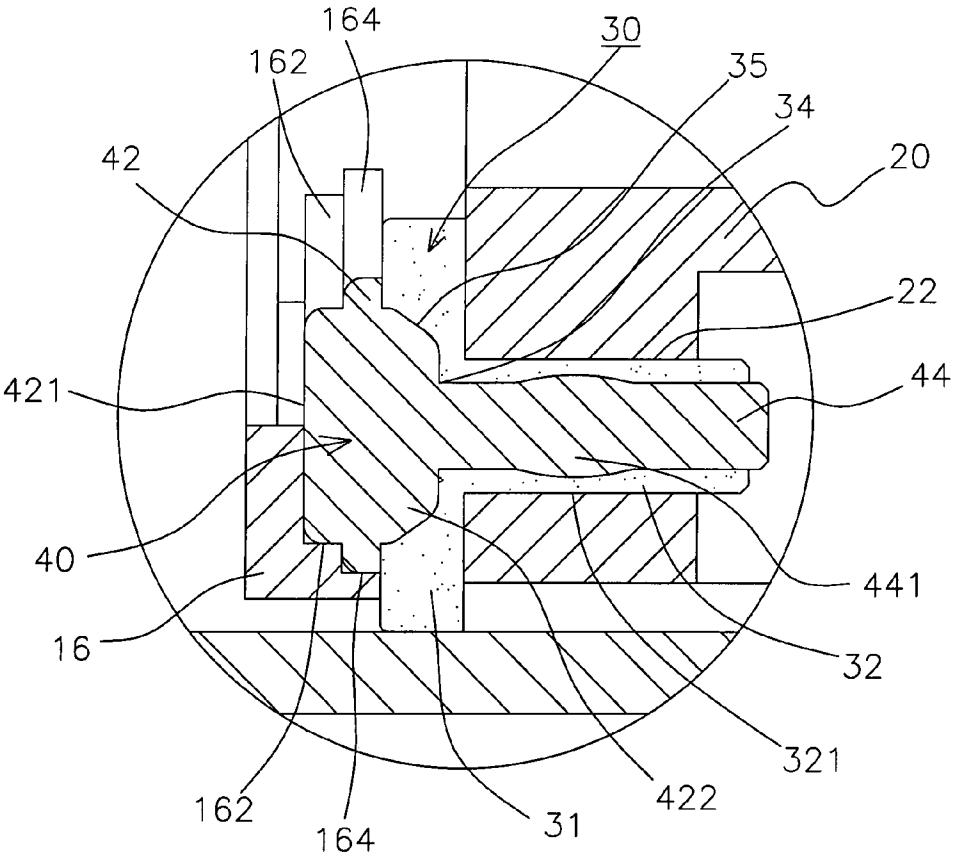
FIG. 7 shows an enlarged view of the encircled portion A in FIG. 5.

Referring to FIG. 1, FIG. 2, FIG. 3, and FIG. 4, the present invention is to provide a vibration absorption device for a fan, which comprises a frame 10 containing a plurality of penetrated, hollow, and U-shape sinks 12 having hollow bottoms, with vertical walls 14 and a plurality of connection rods 16 transversally connected being located between the neighboring sinks 12, (12), and a first groove 162 and a second groove 164 being located close to a corner position of neighboring walls 14 for each connection rod 16 (as shown in FIG. 7); at least more than one fan 20, a front surface and a rear surface of which are provided with a plurality of latching holes 22, respectively (as shown in FIG. 2); a plurality of positioning outer jackets 30 which are made by a flexible material, each interior end of which is formed with a hollow tube 32 having a through-hole 321 (as shown in FIG. 7), and each exterior end of which is provided with a large circular ring 31 having a groove 35 in an interior thereof, with a positioning hole 34 being located in a center of the groove 35 and interconnected with the through-hole 321; and pins 40 which are made by a hard material, each front end of which is formed with a circular ring 42 of larger outer diameter, with an outer wall of the circular ring 42 being integrally formed with an outer-projected circular ring 421 of smaller outer diameter, an inner wall of the circular ring 42 being integrally formed with an inner projection body 422 of smaller outer diameter, an insertion pillar 44 being integrally extended toward an interior along a center of the inner projection body 422, a projected arc member 441 of larger outer diameter being formed on a local circumference of the insertion pillar 44, the insertion pillar 44 being inserted into the positioning hole 34 and the through-hole 321, and the inner projection body 422 being latched into the groove 35.

The hollow tube 32 of positioning outer jacket 30 is inserted into the latching hole 22 of fan 20, the outer-projected circular ring 421 is attached in the first groove 162, and the circular ring 42 is attached in the second groove 164.

Figure 3:
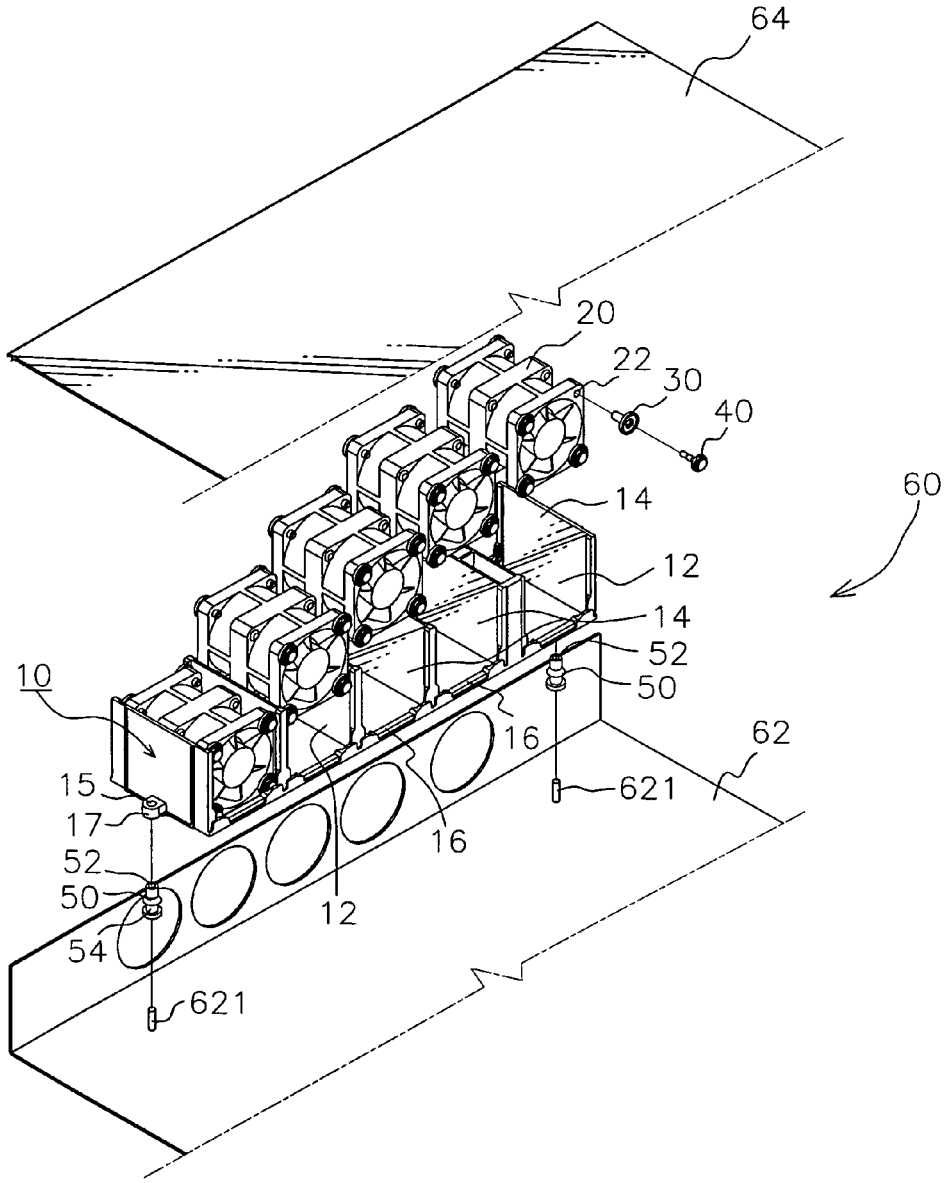
FIG. 3 shows a local exploded view of fans installed onto a frame and a computer casing of the present invention.
Figure 4:
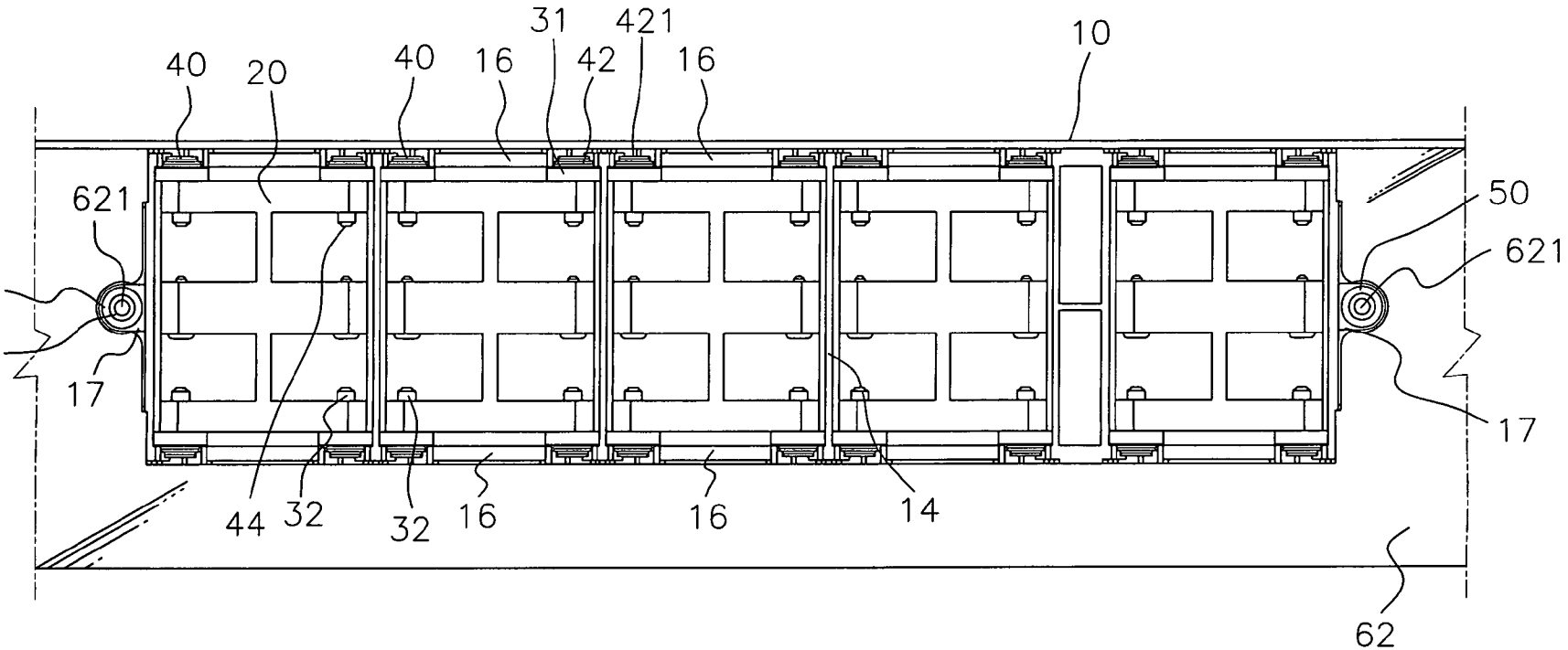
FIG. 4 shows a top view of fans and a frame installed on a substrate of the present invention.
Figure 6:
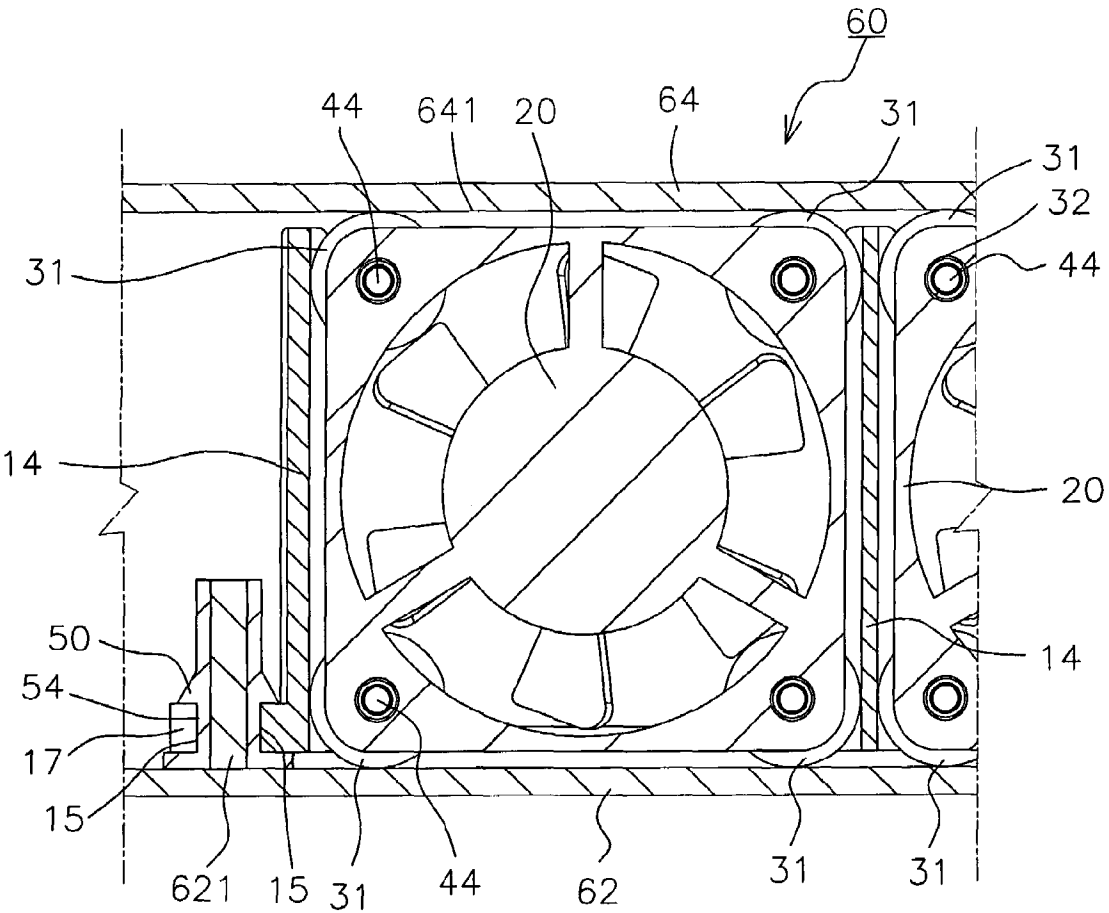
FIG. 6 shows another local cross sectional view of a fan and a frame connected with a computer casing of the present invention.

Referring to FIG. 3 and FIG. 6, two side ends of the frame 10 are provided with insertion holes 15, (15), respectively. A kit 50 made by a flexible material is provided with a vertical through-hole 52 at its center, and can be inserted into the insertion holes 15, (15).

Two pillars 621, (621) are installed on a substrate 62 of a casing 60 of computer host and are inserted into the vertical through-holes 52, (52). The frame 10 is positioned on the substrate 62, and a circumference of large circular ring 31 is touched on the substrate 62.

Referring to FIG. 3 and FIG. 6, ends of the vertical walls 14 of frame 10 are covered by an upper lid 64 of the casing 60 of computer host, wherein the soft circular ring 42 is touched on a bottom surface 641 of the upper lid 64.

Referring to FIG. 3 and FIG. 6, two side ends of the frame 10 are provided with the insertion holes 15, (15), respectively. The kit 50 made by the flexible material is a tube which is provided with the through-hole 52 at its center, and a groove 54 in a shape of circular ring is located on a circumferential surface of the tube. The insertion holes 15, (15) of frame 10 are located on a seat 17 having a certain thickness which is about the same as a height of the ring-shape groove 54, such that the seat 17 can be latched into the ring-shape groove 54.

Referring to FIG. 7, a difference in height exists between the first groove 162 and the second groove 164.

Referring to FIG. 3, the sinks 12 of frame 10 are all in a hollow state, and the neighboring sinks 12, (12) are only connected by the connection rods 16 and vertical walls 14. Accordingly, the material for manufacturing the frame 10 will be lesser and the cost will be lower. In addition, when air flow caused by the fan 20 is flowing, the frame 10 will not interfere with the flow of air.

Figure 5:
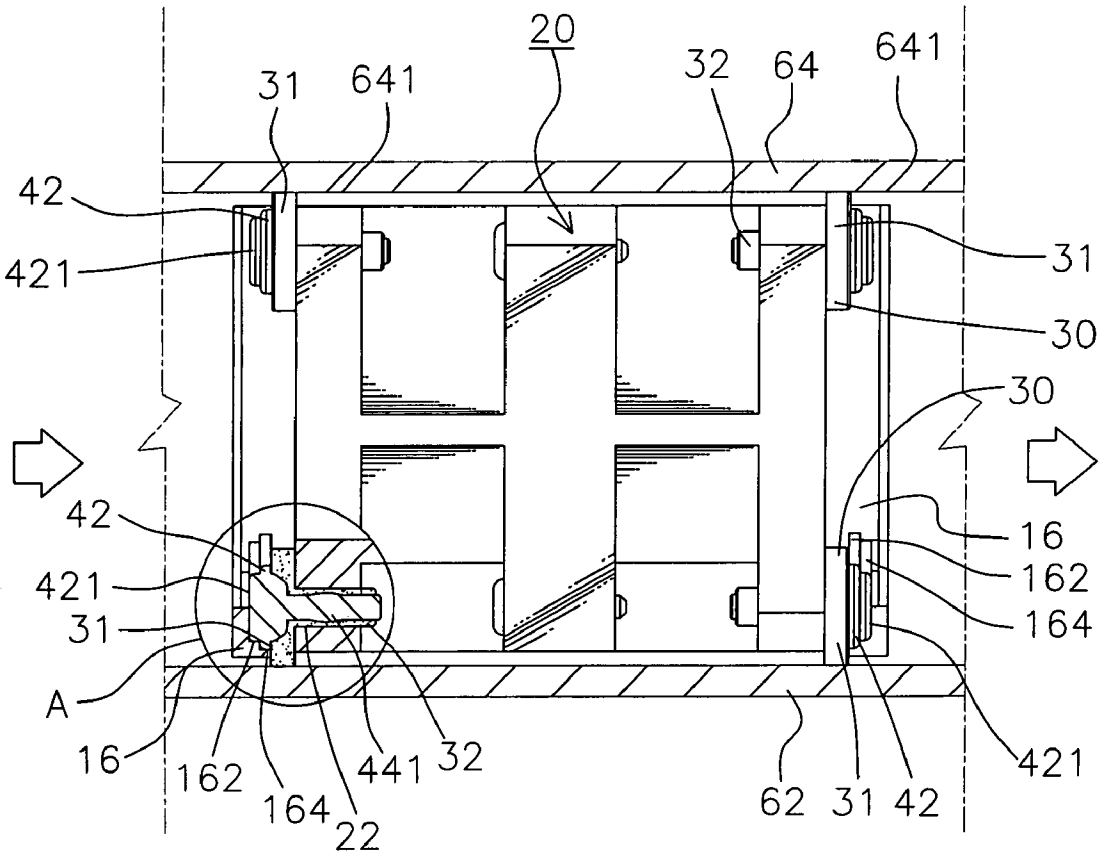
FIG. 5 shows a local cross sectional view of a fan and a frame connected with a computer casing of the present invention.

Referring to FIG. 5 and FIG. 7, when the fan 20 is activated, a vibration force caused by torsion will be transmitted through the positioning outer jacket which is made by a rubber material. As circumferences of a plurality of large circular rings 31 are touched on the bottom surface 641 of upper lid 64 and a surface of substrate 62, respectively, as well as touched on the vertical walls 14, the vibration force will be transmitted onto the substrate 62, upper lid 64, and walls 14, respectively, by the large circular rings 31 (as shown in FIG. 6). During a process of transmitting the moment of vibration force, the vibration force will be greatly reduced due to that the positioning outer jacket 30 is made by the rubber material which is provided with an effect of absorbing vibration. As the kit 50 is a rubber material, the vibration force caused by the entire frame 10 will be absorbed by the kit 50. Therefore, a tiny component of vibration force which is transmitted after absorbing the vibration by the positioning outer jacket 30 will be equally shared by (a) the walls 14, (b) the upper lid 64, (c) the substrate 62, and (d) the kits 50, respectively. Accordingly, the vibration and noise caused by the rotation of fans 20 for the entire casing 60 of computer host will be greatly reduced.

Referring to FIG. 5, the design of projected arc member 441 enables a local tube of hollow tube 32 to be expanded toward exterior, such that the entire pin 40 can be more tightly latched and positioned into the latching hole 22 without being dislocated or escaped from the latching hole 22 due to a long term of vibration. Moreover, as the circular ring 42 and the outer-projected circular ring 421 are all located on the first and second grooves 162, 164, a tiny vibration force transmitted by the pin 40 will also be equally shared by the first and second grooves 162, 164, to achieve a further effect of vibration absorption.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A vibration absorption device for a fan comprising a frame which contains a plurality of penetrated, hollow, and U-shape sinks having hollow bottoms, with vertical walls and a plurality of connection rods transversally connected being located between the neighboring sinks, and a first groove and a second groove being located close to a corner position of neighboring walls for each connection rod; at least more than one fan, a front surface and a rear surface of which are provided with a plurality of latching holes, respectively; a plurality of positioning outer jackets which are made by a flexible material, each interior end of which is formed with a hollow tube having a through-hole, and each exterior end of which is provided with a large circular ring having a groove in an interior thereof, with a positioning hole being located in a center of the groove and interconnected with the through-hole; and pins which are made by a hard material, each front end of which is formed with a circular ring of larger outer diameter, with an outer wall of the circular ring being integrally formed with an outer-projected circular ring of smaller outer diameter, an inner wall of the circular ring being integrally formed with an inner projection body of smaller outer diameter, an insertion pillar being integrally extended toward an interior along a center of the inner projection body, a projected arc member of larger outer diameter being formed on a local circumference of the insertion pillar, the insertion pillar being inserted into the positioning hole and the through-hole, and the inner projection body being latched into the groove; the hollow tube of positioning outer jacket being inserted into the latching hole of fan, the outer-projected circular ring being attached in the first groove, and the circular ring being attached in the second groove.

2. The vibration absorption device for a fan according to claim 1, wherein two sides of the frame are provided with insertion holes respectively, and a kit made by a flexible material having a through-hole in a center and being able to be inserted into the insertion hole; two pillars being installed on a substrate of casing of computer host and being inserted into the vertical through-holes of the kit, the frame being positioned on the substrate, and a circumference of large circular ring being touched on the substrate.

3. The vibration absorption device for a fan according to claim 1, wherein ends of vertical walls of the frame are covered by an upper lid of computer casing, with the soft circular ring being touched on a bottom surface of the upper lid.

4. The vibration absorption device for a fan according to claim 1, wherein the two sides of frame are provided with insertion holes respectively; a kit made by a flexible material being a tube with a through-hole in its center and a ring-shape groove being formed on a circumference of the tube; the insertion holes of frame being installed on a seat having a certain thickness which is about the same as a height of the ring-shape groove, such that the seat can be latched into the ring-shape groove.

5. The vibration absorption device for a fan according to claim 1, wherein a difference in height exists between the first groove and the second groove.

* * * * *